United States Patent [19]

Lamle

[11] Patent Number: 5,048,833

[45] Date of Patent: Sep. 17, 1991

[54] APPARATUS FOR DETECTING A SERIES OF GAME OUTCOMES

[76] Inventor: Steward M. Lamle, 505 E. 79th St., New York, N.Y. 10021

[21] Appl. No.: 486,784

[22] Filed: Mar. 1, 1990

[51] Int. Cl.[5] ..... A63B 71/00; A63F 1/00; A63F 1/18

[52] U.S. Cl. ..... 273/138 A; 273/138 R; 273/143 R; 364/412

[58] Field of Search ..... 273/138 A, 139, 143 R, 273/273, 274, 269; 264/410, 411, 412

[56] References Cited

U.S. PATENT DOCUMENTS

| | | | |
|---|---|---|---|
| 3,770,269 | 11/1973 | Elder | 273/138 A |
| 4,206,920 | 6/1980 | Weatherford et al. | 273/138 A |
| 4,689,742 | 8/1987 | Troy et al. | 364/412 |
| 4,692,863 | 9/1987 | Moosz | 364/410 |
| 4,713,787 | 12/1987 | Rapp | 364/412 |
| 4,858,122 | 8/1989 | Kreisner | 364/410 |

FOREIGN PATENT DOCUMENTS

| | | | |
|---|---|---|---|
| 2520243 | 7/1983 | France | 273/138 A |

*Primary Examiner*—Edward M. Coven
*Assistant Examiner*—Junhee Lee

[57] ABSTRACT

A progressive jackpot is awarded in the event that the outcome of an actual series of games is the same as the outcome of a hypothetical series of games. The hypothetical game outputs are determined by a random number generator and a plurality of jackpots of differing values may be won depending on the number of games in the hypothetical series. The jackpot amount is incrementally increased for each game played which does not result in a jackpot win and is reduced to an initial value after a jackpot win.

11 Claims, 2 Drawing Sheets

APPARATUS FOR DETECTING A SERIES OF GAME OUTCOMES

BACKGROUND OF THE INVENTION

The present invention relates to an apparatus for awarding a progressive jackpot payout in games of chance.

Games of chance having various payout possibilities are well known to those in the art. For example, in the game of roulette, bets such as odd, even, red, and black may provide a payout on a 1 to 1 ratio, while bets on groups of numbers such as first third, second third, or third third provide payouts on a 3 to 1 ratio and bets on a single number such as 7, 12, or 25 provide payouts on a 35 to 1 ratio. Other games such as slot machines offer various payouts depending upon the frequency of appearance of the various symbols on the slot machine wheels. For example, all oranges showing on a 4-wheel machine may pay at the rate of 10 to 1 while all plums pay at the rate of 15 to 1, all bars pay at the rate of 20 to 1, and all 7's pay at the rate of 30 to 1. Although the possibility of various and higher payouts awarding successful bets serves to create a high level of interest in game play, it has been found that high level progressive jackpots which are paid out only rarely upon the occurrence of certain events adds more excitement to such games of chance. While certain progressive payout schemes are known as in U.S. Pat. No. 4,624,459 issued to Kaufman, and U.S. Pat. No. 4,837,728 issued to Barrie et al, the level of payout is not necessarily correlated to the probability of a jackpot payoff occurring; and as a result, such jackpot wins do not occur often enough to sustain a high level of play or occur at such a rate as to exceed the amount of funds which the house has collected in a jackpot pool for payout to jackpot winners.

There is, accordingly, a need in the art for a progressive jackpot payout scheme which sustains a high level of play and is realistically related to the number of bets which have been collected by the house for use in the jackpot pool.

SUMMARY AND OBJECTS OF THE INVENTION

According to the invention, a random number generator in a central computer is used to generate a series of numbers. The series of numbers is used to represent the outcome of a consecutive series of hypothetical games, and during game play, the outcome of actual games is compared to the outcome of the hypothetical games. In the event that all of the hypothetical game outcomes are matched by a consecutive series of actual game outcomes, players who have placed a winning bet on the last of the series of actual games which corresponds with the last of the series of hypothetical games wins the jackpot. Since the series of hypothetical game outcomes represent 6, 8, 10, or more games, the probability of a match between the hypothetical game outcomes and the actual game outcomes is quite low; and as a result, the jackpot payout which increases in value each time a game is played is quite high.

It is, accordingly, an object of the invention to provide a progressive jackpot payout apparatus which relies upon a match between a series of hypothetical game outcomes and a series of actual game outcomes.

It is another object of the invention to provide a progressive jackpot payout apparatus in which the outcome of a number of hypothetical games is randomly generated and compared with the outcome of a series of actual games, and a jackpot which increases in value with each game is awarded in the event of an exact match.

It is yet another object of the invention to provide an apparatus for generating the outcome of a series of hypothetical games and comparing that outcome with the outcome of a series of actual games and awarding a jackpot payout in the event of an exact match between the hypothetical and actual games.

These and other objects of the invention will become apparent from the following detailed description in which reference numerals used throughout the description correspond to those found on the drawing figures.

DESCRIPTION OF THE PREFERRED EMBODIMENT

Figure 1A:
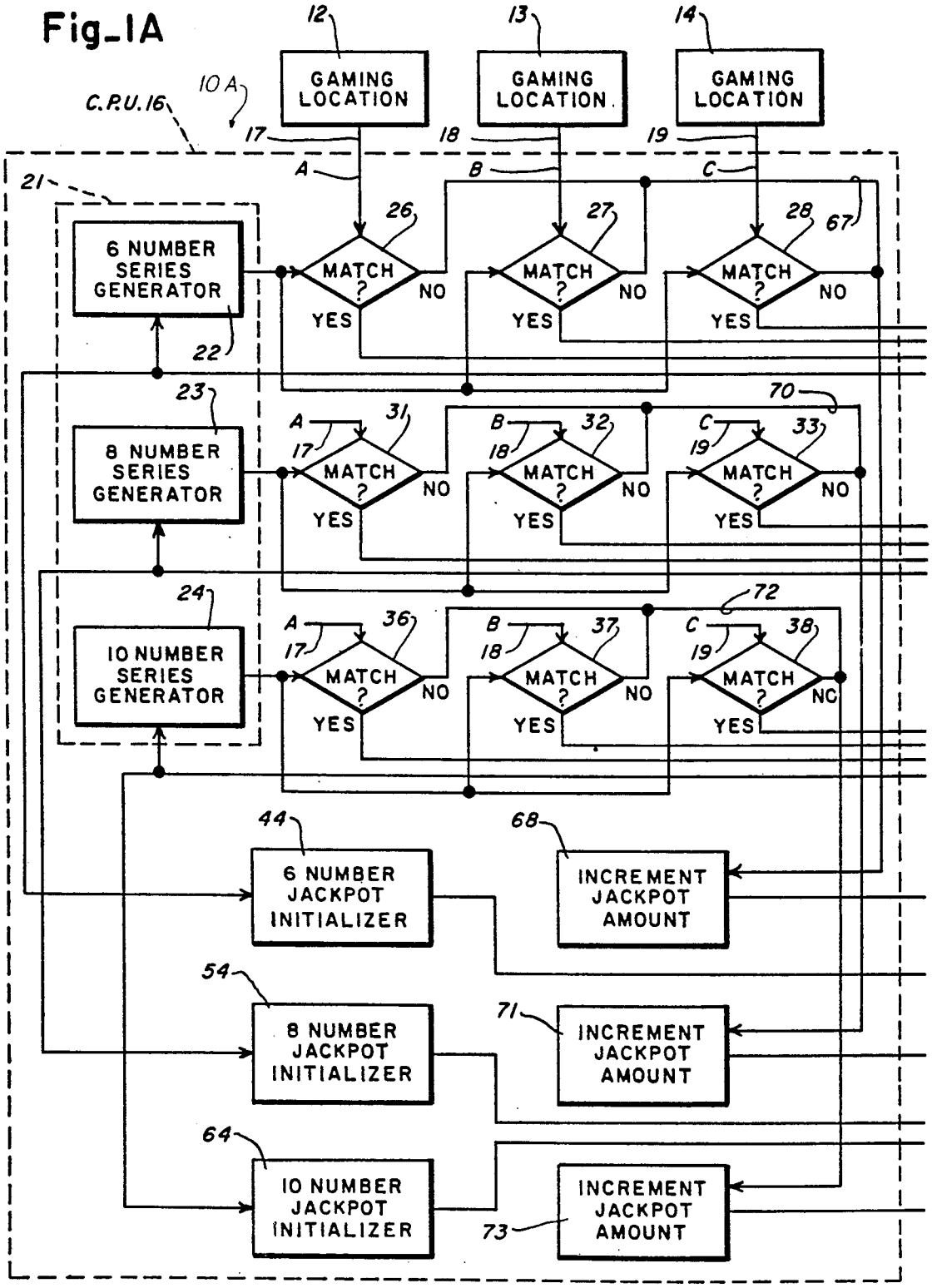
FIGS. 1A and 1B are schematic diagrams of the jackpot awarding apparatus of the invention.
Figure 1B:
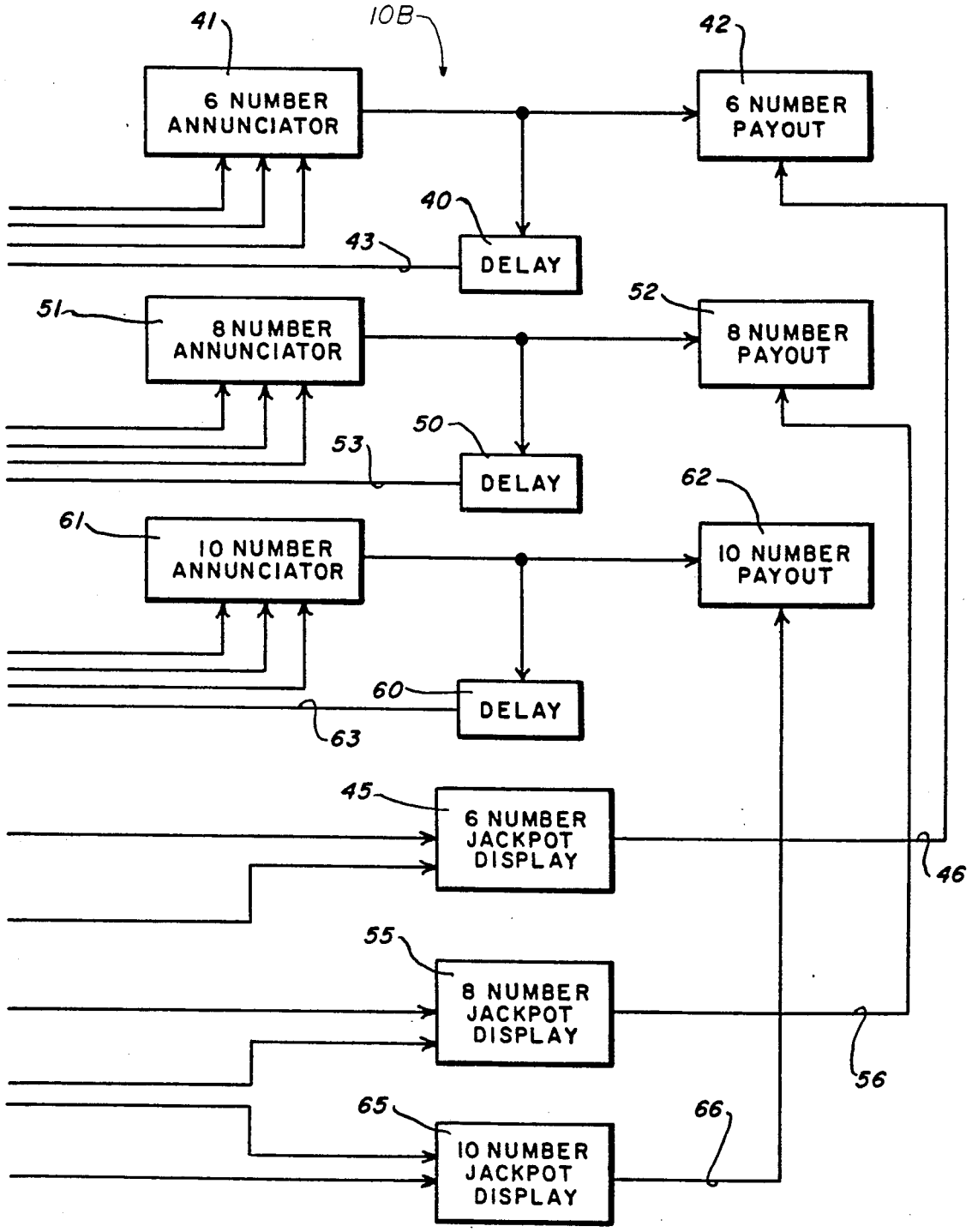

Turning now to the drawing figures, FIGS. 1A and 1B show an apparatus generally designated by the reference numerals 10A and 10B for awarding a jackpot payout upon the occurrence of a certain event. A plurality of gaming locations 12, 13, and 14 are connected to a central processing unit 16 by data links 17, 18, and 19. Each gaming location may comprise a single roulette wheel or slot machine or a table at which a game such as baccarat, craps, or blackjack may be played. It will be understood that three or more gaming locations may be located in a single casino or in several casinos without departing from the spirit and scope of the invention. For purposes of illustration, the gaming location 12 generates data signals A, the gaming location 13 generates data signals B, and the gaming location 14 generates data signals C.

The central processing unit 16 includes a random number generator 21 which includes a 6-number series generator 22, an 8-number series generator 23, and an 10-number series generator 24. The central processing unit further includes a match determining circuit for each game location for each number series which is generated by the random number generator 21. Accordingly, a matching circuit 26 compares the data stream A from gaming location 12 with the output of the 6-number series generator 22, the matching circuit 27 compares the data stream B from the gaming location 13 with the output of the 6-number series generator 22, and the matching circuit 28 compares the data stream C from gaming location 14 with the output of the 6-number series generator 22. In a similar manner, the matching circuits 31, 32, and 33 compare the data streams A, B, and C, respectively, from gaming locations 12, 13, and 14, respectively, with the output from the 8-number series generator 23, and the matching circuits 36, 37, and 38 compare the data streams A, B, and C, respectively, from the gaming locations 12, 13, and 14, respectively, with the 10 random number series generated by the generator 24.

In the event that a match is detected by any of the matching circuits 26, 27, or 28 in the output of the 6-number series generator 22 and the data streams from any of the gaming locations 12, 13, and 14, a signal on the YES output of the respective match detecting circuit will be coupled to the 6-number win annunciator device 41. The 6-number win annunciator device will comprise any combination of lights, sirens, and alarms at an appropriate location or locations to attract attention to the fact that a jackpot winner is being awarded and to actuate the 6-number payout 42 at the appropriate gaming location. At the same time, the annunciator 41 sends a signal to a delay 40 coupled to reset line 43 and the 6-number series generator 22 to generate a new 6-number series. The signal on reset line 43 is additionally coupled to a 6-number jackpot initializer 44 to set the 6-number jackpot amount at the starting level in the event that the jackpot has been incremented during previous game play. The initialized jackpot amount is displayed on the 6-number jackpot display 45 which is coupled to the 6-number payout by the line 46 in order to control the payout amount at the time of the next jackpot win.

In a similar fashion if a match is detected by any of the matching circuits 31, 32, and 33 between the data streams A, B, and C from the gaming locations 12, 13, and 14 and the 8-number series generator 23, a signal from the YES output of the matching circuits is coupled to the 8-number win annunciator 51 at an appropriate location or locations. A signal from the 8-number win annunciator 51 is coupled to the 8-number payout 52 at the appropriate gaming location and to a delay 50 which sends a reset signal on line 53 to the 8-number series generator 23 in order to generate a new 8-number series and to the 8-number jackpot initializer 54 in order to reset the 8-number jackpot to an initial value. The 8-number jackpot initializer 54 is coupled to the 8-number jackpot display 55 which in turn is coupled to the 8-number payout 52 by the line 56 to control the payout amount. In the same way if a match is detected by either of the match circuits 36, 37, and 38 in the data stream A, B, or C from the gaming locations 12, 13, or 14 and the 10-number series generator 24, an output on the YES output of the respective match circuit is coupled to the 10-number win annunciator 61 at an appropriate location or locations. The 10-number win annunciator 61 provides a signal to the 10-number payout 62 at the appropriate gaming location and to a delay 60 which sends a reset signal on the line 63 to the 10-number series generator 24 and to the 10-number jackpot initializer 64. The jackpot initializer 64 is coupled to the 10-number jackpot display 65 which is coupled by the line 66 to the 10-number payout 62 to control the payout amount.

Each time a game is played and the matching circuits 26, 27, and 28 fail to detect a match in the data stream from the gaming locations and the 6-number series generator 22, a signal is provided on the NO output line 67 to the increment jackpot circuit 68. The increment circuit 68 is coupled to the 6-number jackpot display 45 and causes the display to be incremented by some predetermined amount. In a similar manner, when the matching circuits 31, 32, and 33 fail to detect a match between the data streams A, B, and C and the output of the 8-number series generator 23, a signal on the NO output line 70 is coupled to the increment jackpot circuit 71. The increment circuit 71 is coupled to the 8-number jackpot display 55. In the same way, when the matching circuits 36, 37, and 38 fail to detect a match, between the data streams A, B, and C from the gaming locations 12, 13, and 14 and the output of the 10-number series generator 24, a signal is provided on the NO output line 72 and is coupled to the increment jackpot circuit 73. The increment jackpot circuit 73 is coupled to the 10-number jackpot display 65.

An example will serve to illustrate the operation of the device. For example in the game of roulette, the random number generator 21 could generate the 6-number sequence 33, 2, 18, 00, 4 and 23 in the 6-number series generator 22, the 8-number sequence 1, 15, 7, 29, 30, 18, 22, 4 in the 8 -number series generator 23, and the 10-number sequence 22, 19, 7, 31, 5, 25, 11, 0, 20, 29 in the 10-number series generator 24. If the ball on the roulette table at gaming location 12 lands on slot 33 in one game and slot 2 in the next game, slot 18 on the next, 00 on the next, 4 on the next, and 23 on the next, the random number series from generator 22 has been matched by the actual data stream A from gaming location 12. In that event, any player who has bet on 23 in the last game played is awarded the jackpot. In the event more than one player has played 23 on the last game, then the players share the jackpot. Also, a player who bet ODD during the last play would share in the jackpot as well as any player who bet on RED (assuming the number 23 is red on the roulette table) or any other bet category into which the number 23 falls according to the usual rules of roulette. As a result of the 6-number match, an announcement is made on the 6-number annunciator 41; and a payout is made at the 6-number payout 42 in accordance with the amount shown on the 6 number jackpot display 45. After a delay, the jackpot amount for a 6-number series is initialized by the circuit 44; and this initialized jackpot amount is displayed on the 6-number jackpot display 45.

During the first 5 of the 6 games described above, the outputs of matching circuits 26, 31 and 36 would be NO during each game since the 5-number series in the data stream A is not a complete match with the 6-number series from the generator 22, the 8-number series from the generator 23 or the 10-number series from the generator 24. As a result, signals on the NO output lines 67, 70 and 72 would increment the 6-, 8- and 10-number series jackpot amounts by means of the increment circuits 60, 71 and 73 and show the incremented jackpot amount on displays 45, 55 and 65, respectively. After the sixth game, matching circuit 26 will have a YES output, while matching circuits 31 and 36 will continue to have a NO output.

It is assumed that according to normal progressive jackpot betting schemes, the initialized jackpot amount for the 8-number series would be greater than the initialized jackpot amount for the 6-number series and that the initialized jackpot amount for the 10-number series would be higher yet. Also, since the statistical probability of matching an 8-number series is less than matching a 6-number series, the 8-number jackpot amount will be incremented a greater number of times than the 6-number jackpot before a match occurs; and the 10-number jackpot amount will be incremented a greater number of times than the 8-number jackpot amount.

It will also be understood that the jackpot payout scheme of the invention is applicable to games other than roulette. Any games in which a bet is placed on either a number, a symbol, or an event which can be represented by a number, a symbol, or some indicia may utilize the progressive jackpot payout as described above. In implementing the invention in connection with games which utilize symbols or events, the number generator will generate series of symbols or indicia to correspond to the symbols or events which are generated at the gaming locations.

Having thus described the invention, various alterations and modifications will occur to those skilled in the art, which alterations and modifications are intended to be within the scope of the present invention as defined by the appended claims.

What is claimed is:

1. An apparatus for awarding a jackpot win to a player having a winning bet placed on a gaming device, the apparatus comprising:

first random number generating means for generating a first plurality of random numbers representative of game outcomes from a series of hypothetical games;

means for comparing the first plurality of random numbers with the game outcomes from a series of actual games played on the gaming device; and means for awarding a jackpot win to a player having a winning bet on the last game of said series of actual games in the event that the game outcomes from said series of actual games are the same as the first plurality of random numbers.

2. The apparatus of claim 1 further comprising:

a second random number generating means for generating a second plurality of random numbers representative of game outcomes from a series of hypothetical games;

means for comparing the second plurality of random numbers with the game outcomes from a series of actual games played on the gaming device; and means for awarding a jackpot win in the event that the game outcomes from said series of actual games are the same as the second plurality of random numbers.

3. The apparatus of claim 2 further comprising:

means for establishing a first jackpot amount at an initial amount;

means for incrementing the first jackpot amount following each actual game if the first jackpot amount is not awarded; and means for reducing the first jackpot amount to the initial amount in the event that the first jackpot amount is awarded; and means for awarding the first jackpot amount as the jackpot win if the game outcomes from a series of actual games is the same as the first plurality of random numbers.

4. The apparatus of claim 2 wherein the second plurality of random numbers represents a greater number of hypothetical games than the first plurality of numbers.

5. The apparatus of claim 4 further comprising:

a third random number generating means for generating a third plurality of random numbers representative of game outcomes from a series of hypothetical games;

means for comparing the third plurality of random numbers with the game outcomes from a series of actual games played on the gaming device; and means for awarding a jackpot win in the event that the game outcomes from said series of actual games are the same as the third plurality of random numbers.

6. The apparatus of claim 5 wherein the third plurality of random numbers represents a greater number of hypothetical games than the second plurality of numbers.

7. The apparatus of claim 3 further comprising:

means for establishing a second jackpot amount at an initial amount;

means for incrementing the second jackpot amount following each actual game if the second jackpot amount is not awarded;

means for reducing the second jackpot amount to the initial amount in the event the second jackpot is awarded;

means for awarding the second jackpot amount as the jackpot win if the game outcomes from a series of actual games is the same as the second plurality of random numbers.

8. The apparatus of claim 7 wherein the second plurality of random numbers represents a greater number of hypothetical games than the first plurality of numbers.

9. The apparatus of claim 8 further comprising:

a third random number generating means for generating a third plurality of random numbers representative of game outcomes from a series of hypothetical games;

means for comparing the third plurality of random numbers with the game outcomes from a series of actual games played on the gaming device; and means for awarding a jackpot win in the event that the game outcomes from said series of actual games are the same as the third plurality of random numbers.

10. The apparatus of claim 9 wherein the third plurality of random numbers represents a greater number of hypothetical games than the second plurality of numbers.

11. The apparatus of claim 10 further comprising:

means for establishing a third jackpot amount at an initial amount;

means for incrementing the third jackpot amount following each actual game if the third jackpot amount is not awarded;

means for reducing the third jackpot amount to the initial amount in the event the third jackpot is awarded; and means for awarding the third jackpot amount as the jackpot win if the game outcomes from a series of actual games is the same as the third plurality of random numbers.

* * * * *